US007275338B2

(12) United States Patent
LaHood

(10) Patent No.: US 7,275,338 B2
(45) Date of Patent: Oct. 2, 2007

(54) EDGE PROTECTOR ASSEMBLY FOR BUCKET ASSEMBLY

(75) Inventor: James R. LaHood, Peoria, IL (US)

(73) Assignee: Caterpillar Inc, Peoria, IL (US)

( * ) Notice: Subject to any disclaimer, the term of this patent is extended or adjusted under 35 U.S.C. 154(b) by 12 days.

(21) Appl. No.: 10/924,393

(22) Filed: Aug. 24, 2004

(65) Prior Publication Data

US 2006/0042130 A1 Mar. 2, 2006

(51) Int. Cl.
*E02F 9/28* (2006.01)

(52) U.S. Cl. ..... 37/449

(58) Field of Classification Search ..... 37/444, 37/446, 448, 449, 455; 172/772, 772.5
See application file for complete search history.

(56) References Cited

U.S. PATENT DOCUMENTS 1,580,725 A * 4/1926 Harrison ..... 37/448
3,089,261 A * 5/1963 Flath ..... 37/448
3,736,675 A 6/1973 Shankwitz et al.
3,748,762 A 7/1973 Tarrant
3,851,413 A * 12/1974 Lukavich ..... 37/451
3,914,885 A 10/1975 Moreau
3,961,788 A * 6/1976 Helton et al. ..... 172/701.2
3,967,398 A 7/1976 Stepe
4,007,550 A * 2/1977 Stepe ..... 37/448
4,047,312 A * 9/1977 Stepe ..... 37/448
4,055,223 A * 10/1977 Casey et al. ..... 172/777
4,071,967 A 2/1978 Klett
T973,002 I4 8/1978 Klett
4,182,057 A * 1/1980 Klett et al. ..... 37/448
4,204,349 A 5/1980 Tallis
4,249,326 A * 2/1981 Merkel ..... 37/448
4,290,214 A * 9/1981 Stepe ..... 37/448
4,776,113 A * 10/1988 Bedford et al. ..... 37/448
5,016,365 A 5/1991 Robinson (Continued)

OTHER PUBLICATIONS

Hensley Industries, Inc., Installation Instructions for VS410 and VS181; Installation Instructions for VS450, VS500, and VS550; Vertical Shroud Extension; Vertical Wear Shrouds for Excavators, Loaders, and Front Shovels; Installing the BladeSaver II; Replacing Mechanically-Attached Wear Parts; pp. 2-13; Dallas, Texas.

*Primary Examiner*—Victor Batson
(74) *Attorney, Agent, or Firm*—Liell + McNeil; Andrew J. Ririe

(57) ABSTRACT

An edge protector assembly is attached, via at least two connectors, to an edge of at least one wall surface of a bucket assembly. Each connector includes a first mating portion that is mated to at least one second mating portion of an edge protector of the edge protector assembly. One of the first and second mating portions includes a protrusion with a tapered section and the other includes a tapered cavity that receives the tapered section. A fastener assembly secures the edge protector to the connectors, and includes a fastener extending through a bore defined by the first and second mating portions. An inner wall of the bore and an outer surface of the fastener are out of contact with one another to avoid shear loads on the fasteners. The edge protector assembly includes an inner overhang area that is preferably zero percent, but up to one half of a protection area of the edge covered by the edge protector assembly.

25 Claims, 7 Drawing Sheets

U.S. PATENT DOCUMENTS

| | | | | |
|---|---|---|---|---|
| 5,224,555 | A | 7/1993 | Bain et al. | |
| 5,333,696 | A | 8/1994 | Cornelius | |
| D378,006 | S | 2/1997 | Clendenning | |
| 5,680,717 | A * | 10/1997 | Bierwith | 37/444 |
| 6,712,551 | B2 | 3/2004 | Livesay et al. | |
| 6,718,662 | B1 * | 4/2004 | Schaff | 37/405 |
| 6,766,602 | B2 | 7/2004 | Cox et al. | |
| 2003/0066215 | A1 | 4/2003 | Grant | |
| 2004/0025381 | A1 | 2/2004 | Cox et al. | |
| 2004/0098887 | A1 | 5/2004 | Livesay | |

* cited by examiner

EDGE PROTECTOR ASSEMBLY FOR BUCKET ASSEMBLY

TECHNICAL FIELD

The present disclosure relates generally to bucket assemblies used with work machines, and more specifically to edge protector assemblies for the bucket assemblies.

BACKGROUND

Work machine implements, such as bucket assemblies for mining equipment, are subjected to high wear due to the harsh environment in which they operate. Specifically, portions of the bucket assembly, such as side bars, that penetrate the ground and/or material which is to be moved are subjected to the greatest amount of wear. A worn side bar can be relatively expensive and time consuming to replace. Because the side bars are generally made from steel and are welded to the bucket assembly, a worn portion of the side bar must be cut out of the bucket assembly and a new portion welded into place. Thus, many bucket assemblies include side bar protectors that are attached to an edge of the side bar that penetrates the material. The side bar protectors are much more economical and less time consuming to replace than the side bar, itself.

Often, side bar protectors are removeably attached to the edges of the side bars by connectors, such as brackets, that are welded or bolted to the side bars. For instance, a side bar protector assembly set forth in U.S. Pat. No. 5,016,365, issued to Robinson, on May 21, 1991, includes side bar protectors with U-shaped cross sections that are attached to mounts welded to a bucket assembly. The mounts fits inside of the side bar protectors and are secured by pins extending through aligned apertures of the mount and side bar protector. The U-shaped cross-section allows the side protectors to wrap around the bucket edge.

Although side bar protectors, such as the Robinson protector, protect the side bar edge from wear, many side bar protector assemblies are substantially wider than the side bar, and thus, create an overhang into the bucket assembly. The overhang of the protector can trap material between the protector and the side bar wall. The material trapped in the bucket is commonly referred to as carry back, and reduces the productivity of the work machine.

Moreover, although side bar protectors are more economical to replace than the side bar, the side bar protectors are also subjected to wear. During operation of the bucket assembly, the side bar protector will be repeatedly subjected to various loads and impacts. If the loads are not adequately transferred to the bucket assembly through the brackets, the loads can cause a fastener assembly, often consisting of a nut threaded to a bolt, to shear and fail. For instance, an interface between the mount and the Robinson side bar protector may not provide sufficient contact surface in order to adequately transfer the loads to the bucket assembly, rather than through the pin securing the assembly.

Further, due to wear, the side bar protectors must be periodically replaced or repositioned. The detachment and reattachment of the protectors can consume valuable time in which that the work machine could be operating. In addition, at least two tools are often required; one to hold a nut from rotating while another is used to rotate the bolt.

SUMMARY OF THE DISCLOSURE

In one aspect of the present disclosure, a bucket assembly includes a bucket including at least one wall surface with an edge. At least two connectors are attached to the edge and include a first mating portion that is mated to at least one second mating portion of an edge protector within an edge protector assembly. The edge protector assembly includes a fastener assembly that is operable to secure the edge protector to the connectors. The edge protector assembly covers a protection area of the edge, and includes an inner overhang area that is between zero and one half of the protection area.

In another aspect of the present disclosure, a bucket assembly includes a bucket including at least one wall surface with an edge. An edge protector assembly is attached to the edge, and includes at least two connectors, and edge protector and a fastener assembly for each connector. A first mating portion of each connector is mated to at least one second mating portion of the edge protector, and the fastener assemblies secure the edge protector to each connector. Each fastener assembly includes a fastener extending through a bore defined by the first and second mating portions. An inner wall of the bore and an outer surface of the fastener being out of contact.

In another aspect of the present disclosure, an edge protector assembly for use with a bucket assembly includes at least two connectors, an edge protector and a fastener assembly that is operable to secure the edge protector to the connectors. A first mating portion of each connector is operable to mate to at least one second mating portion of the edge protector. One of the first and second mating portions includes a protrusion with a tapered section. The other of the first and second mating portions includes a tapered cavity that receives the tapered section.

In another aspect of the present disclosure, an edge of a bucket assembly is protected. One of a bolt and a nut included within a fastener assembly is prevented from rotating by an interaction with one of a connector and an edge protector. The fastener assembly is secured, at least in part, by rotating the other of the bolt and nut with a tool.

DETAILED DESCRIPTION

Figure 1:
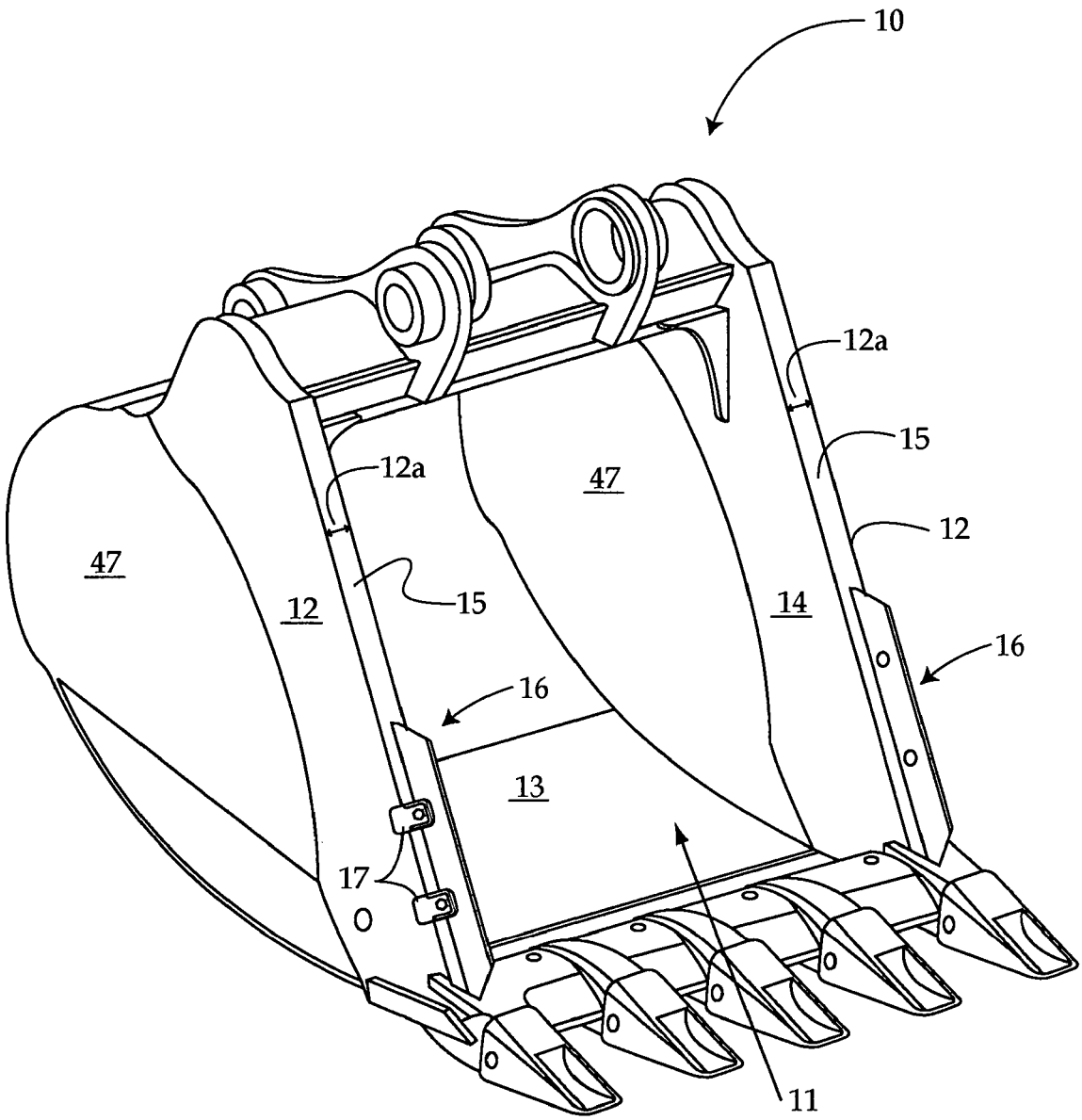
FIG. 1 is a diagrammatic representation of a bucket assembly, according to the present disclosure.

Referring to FIG. 1, there is shown a diagrammatic representation of a bucket assembly 10, according to the present disclosure. The bucket assembly 10 is designed as a work machine implement for use with various work machines, including, but not limited to, mining shovels, excavators and wheel loaders. Thus, although an excavator type bucket is shown, this disclosure contemplates other bucket types, such as loader buckets. As used in this document the term "bucket" also encompasses bulldozer blades that include side walls with edges for protecting from wear. The bucket assembly 10 includes a bucket 11 that is defined, in part, by two identical sides 47 separated from one another by a middle section 13. Identical side bars 12 are attached to both sides 47. The middle section 13 may be formed from one piece of material or several pieces welded to one another. The side bars 12 and middle section 13 are generally made from a relatively strong material, such as steel plate. Teeth can be attached across a front of the middle section 13 and the side bars 12 in order to help penetrate the material being loaded and moved. Each side bar 12 includes a width 12*a*. The present disclosure contemplates side bars 12 of various widths, including, but not limited to, side bars up to and exceeding three inches thick. Each side bar 12 includes an inner side wall surface 14 with an edge 15. Identical edge protector assemblies 16 are attached to each edge 15 of the side wall surfaces 14 by at least two connectors 17. Each edge protector assembly 16 is attached to the edge 15 at a position where the bucket 11 repeatedly penetrates material and debris, and can be made from the same or different material than the side bars 12.

Figure 2A:
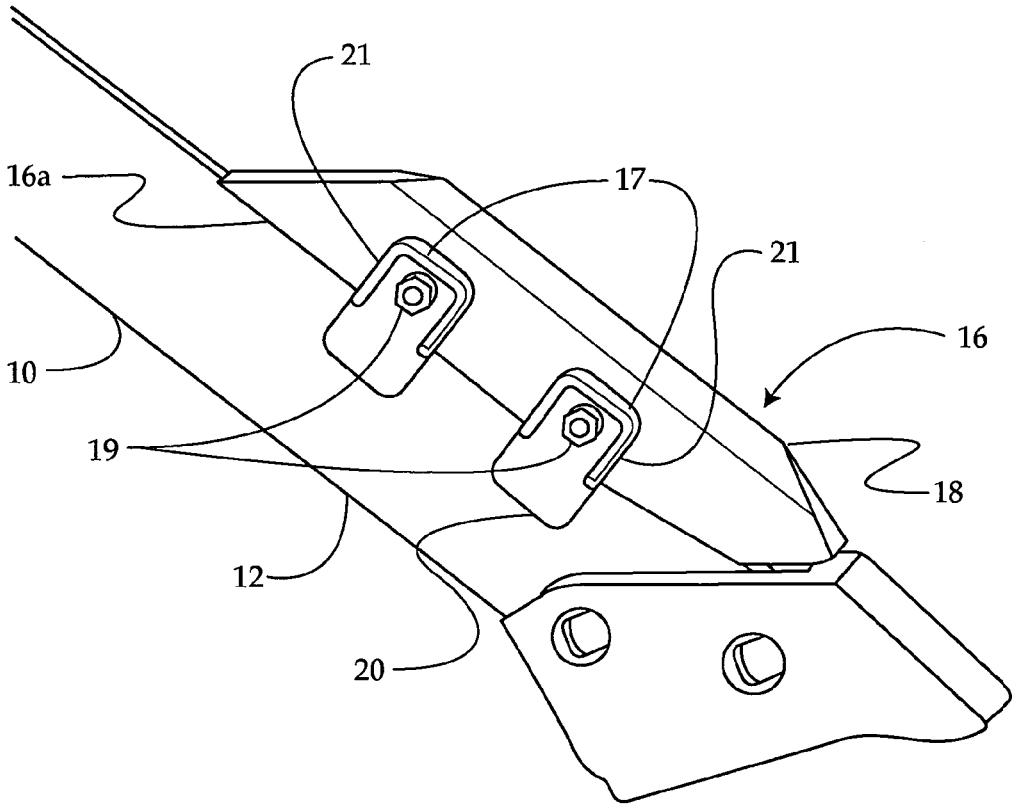
FIG. 2*a* is a partial perspective diagrammatic view of an outer surface of an edge protector assembly attached to the bucket assembly of FIG. 1.
Figure 7A:
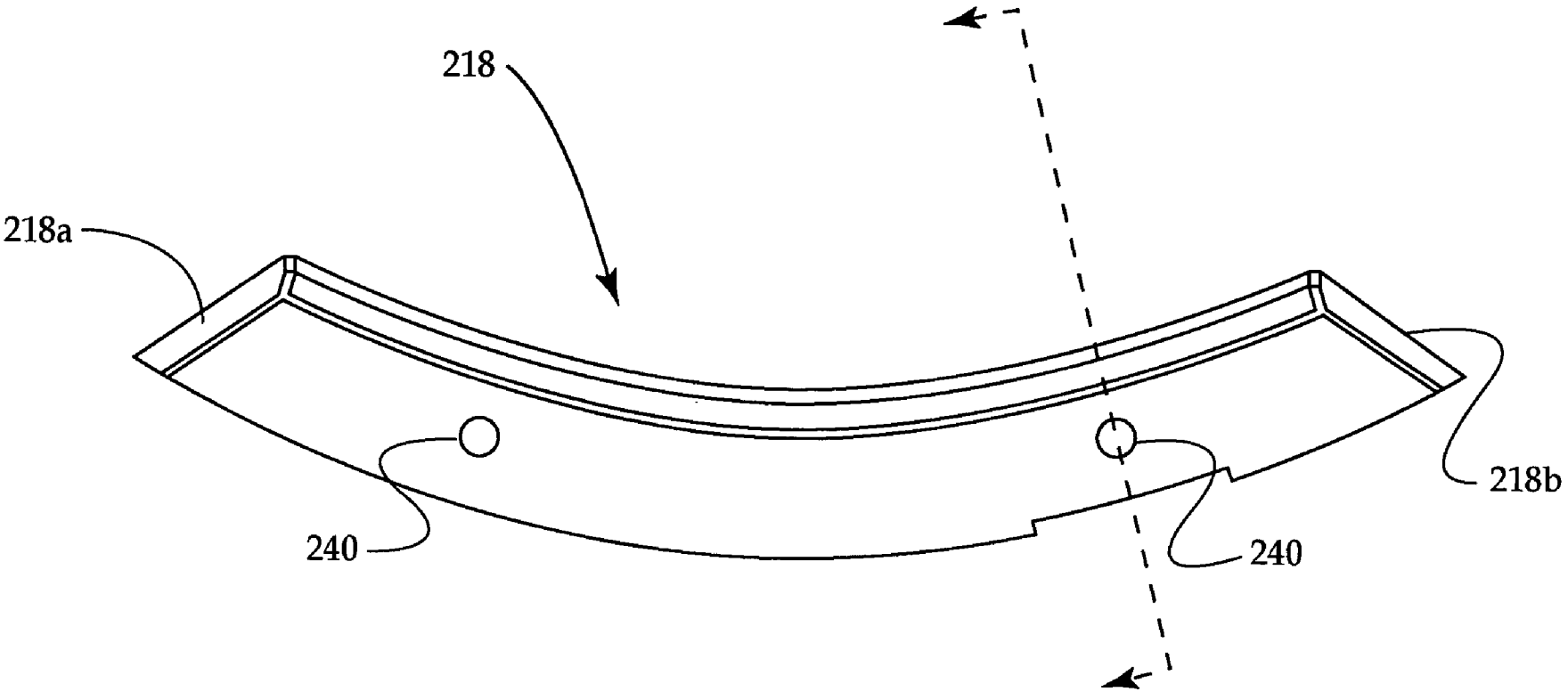
FIG. 7*a* is an isometric diagrammatic view of an edge protector included within an edge protector assembly, according to a third embodiment of the present disclosure.

Referring to FIG. 2*a*, there is shown a side view of an outer surface 16*a* of the edge protector assembly 16 attached to the bucket assembly 10 of FIG. 1. Although the present disclosure will be discussed for one edge protector assembly 16, it should be appreciated that the discussion can apply to both edge protector assemblies. The edge protector assemblies 16 are identical to one another, and thus, can be switched between the two side bars 12. The edge protector assembly 16 includes an edge protector 18 secured to the connectors 17 via fastener assemblies 19. The connectors 17 can be attached to the side bars 12 in various ways, but preferably are welded to the side bars 12. Although the present disclosure contemplates any number of connectors 17 per edge protector 18, preferably there are at least two connectors 17 in order to limit the movement of the edge protector 18 relative to the connectors 17. The connectors 17 are illustrated as brackets. Although the brackets 17 are illustrated as including a flange 20 and protective shield 21, the present disclosure contemplates brackets without flanges or protective shields. The protective shield 21 is designed to protect from wear a portion of the fastener assembly 19 that extends past the edge protector assembly 16. Although the edge protector 18 is illustrated as straight for use with bucket assemblies for work machines, such as relatively large wheel loaders, it should be appreciated that the present disclosure contemplates edge protectors with various other shapes, such as a curved shape (as shown in FIG. 7*a*).

Figure 2B:
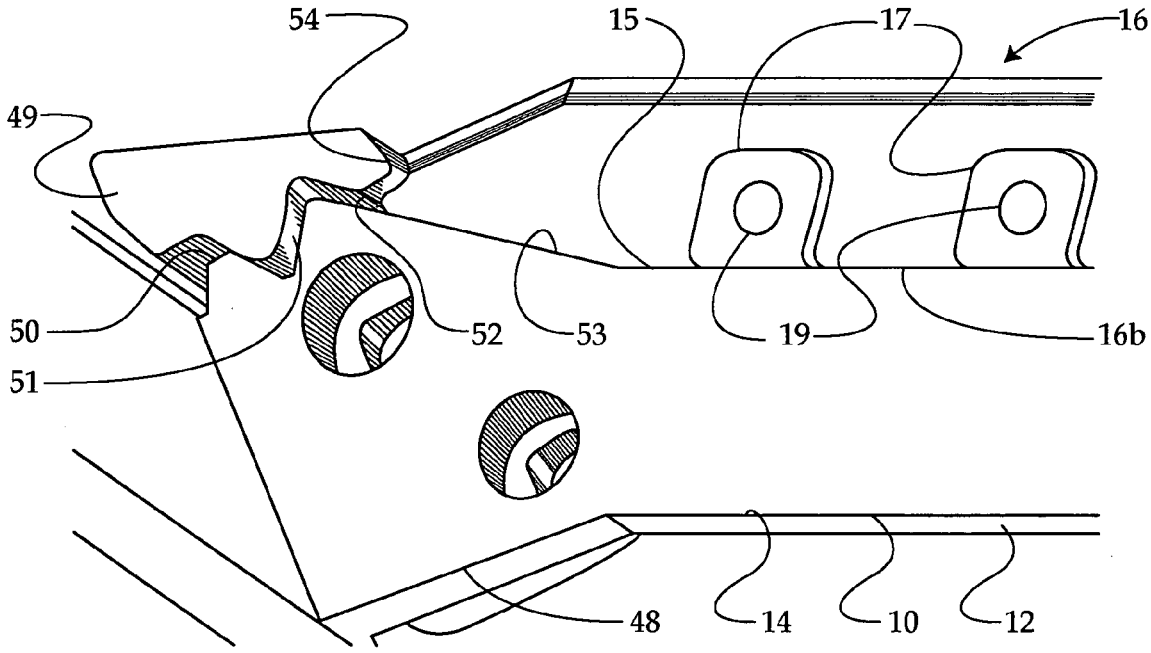
FIG. 2*b* is a partial perspective diagrammatic view of an inner surface of the edge protector assembly attached to the bucket assembly of FIG. 1.

Referring to FIG. 2*b*, there is shown a side view of an inner surface 16*b* of the edge protector assembly 16 attached to the bucket assembly 10 of FIG. 1. In the illustrated embodiment, the side bar 12 includes a corner 48 attached to the front of the bucket assembly 10 that includes the teeth. It is known in the art to attach a corner protector 49 onto the edge 15 of the corner 48 in order to protect the corner 48 when penetrating material and debris. In the illustrated embodiment, the edge 15 includes a front portion 50 that is serrated and mates with a corresponding serrated surface 51 of the protector 49, and a top portion 53. The edge protector assembly 16 preferably includes a tooth 52 that mates under a protrusion 54 of the corner protector 49 that extends over and protects the top portion 53 of the edge 15. Because the tooth 52 fits against the protrusion 54 of the corner protector 49, the corner protector 49 can share a side load with the edge protector assembly 16. The load can be transferred between the edge protector assembly 16 and the corner protector 49. It should be appreciated that the present invention contemplates the use of the tooth 52 with straight edge protector assemblies as shown in FIGS. 2*a* and 2*b*.

Figure 3:
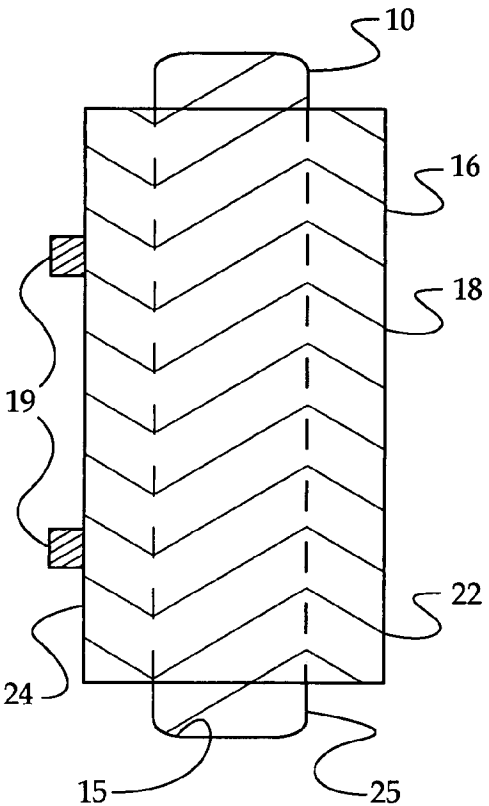
FIG. 3 is a cross-sectional top diagrammatic representation of the edge protector assembly attached to the bucket assembly of FIG. 2.
Figure 9:
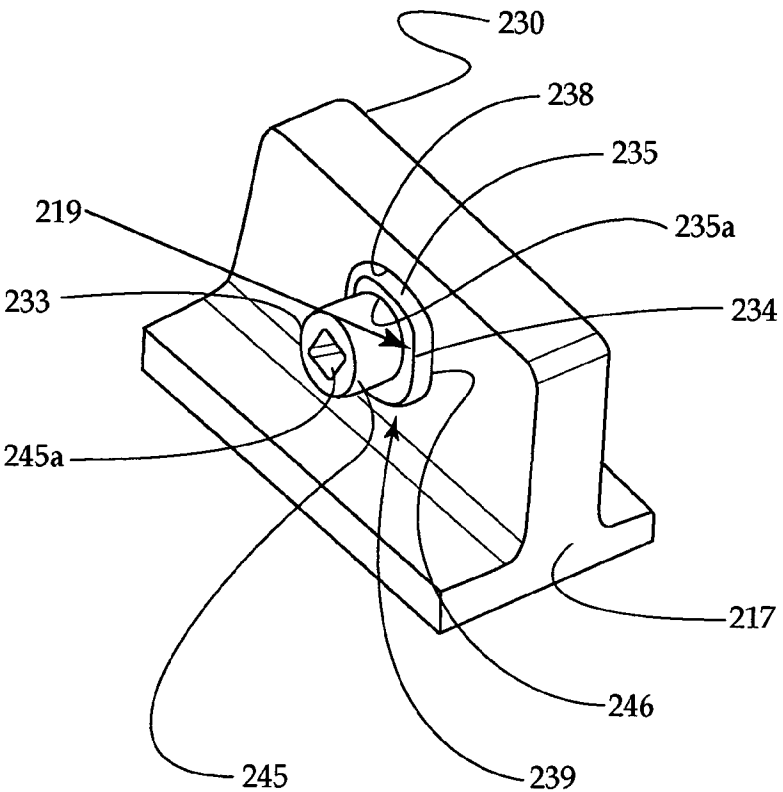
FIG. 9 is an isometric diagrammatic view of a fastener assembly mated to a connector, according to the third embodiment of the present disclosure.

Referring to FIG. 3, there is shown a partial cross-sectional top diagrammatic representation of the edge protector assembly 16 attached to the bucket assembly 10 of FIG. 2. The edge protector assembly 16 includes an overhang area 22 extending from the side wall surface 14 into the bucket 11, a protection portion (not shown) covering a protection area 25 of the edge 15, and an outer area 24 extending from an outer surface of the side bar 12 away from the bucket 11. In all embodiments, the inner overhang area 22 is between zero and one half of the protection area 25 of the edge 15. Although the inner overhang area 22 is illustrated as being one half of the protection area 25, preferably, the inner overhang area of the edge protector assembly 16 is zero percent of the protection area 25, meaning that the edge protector assembly 16 is flush with the surface side wall 14 and there is no inner overhang. Although the outer area 24 is also illustrated as one half of the protection area 25, the present disclosure contemplates the edge protector assembly with an outer area being of various sizes, or no outer area. It should be appreciated that the greater the width 12*a* of the side bar 12, the more likely the edge protector assembly 16 will be flush with the side wall surface 14. The greater width can provide more room for the brackets 17 that must be sufficiently thick to mate with and support the edge protector 18. For instance, the present disclosure contemplates the edge protector assembly (as shown in FIGS. 7–9) being flush with the side wall surface 14 when attached to a three-inch wide side bar, like the side bars used in relatively large mining loaders, shovels and excavators. However, when used to protect one inch side bars 12, similar to the side bars of wheel loaders, the edge protector assembly 18 (illustrated in FIG. 3) can include up to the inner overhang area 22 that is one half of the protection area 25.

Figure 4:
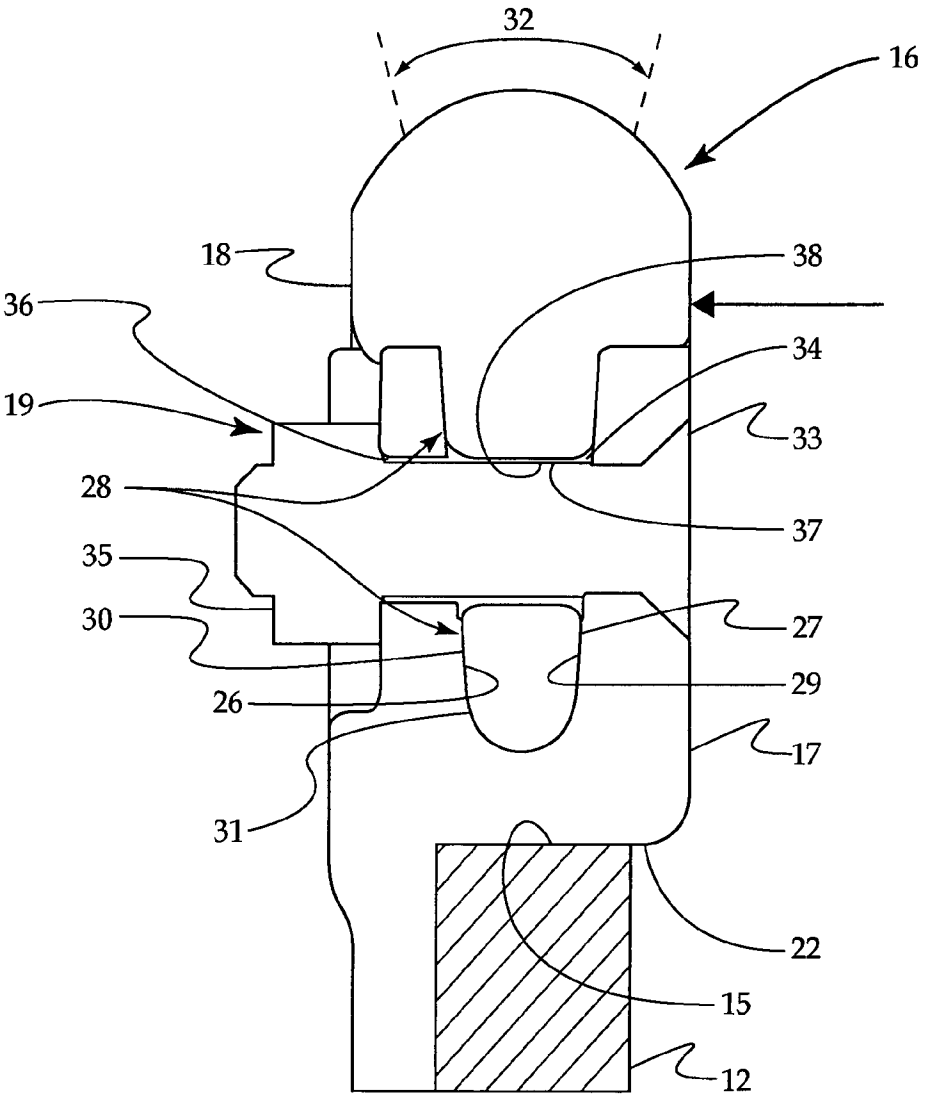
FIG. 4 is a cross-sectional side diagrammatic representation of the edge protector assembly, according to a first embodiment of the present disclosure.

Referring to FIG. 4, there is shown a cross-sectional side diagrammatic representation of the edge protector assembly 16, according to a first embodiment of the present disclosure. Although the section is through one bracket 17, it should be appreciated that the section through all of the brackets 17 mated to the edge protector 18 are identical. The bracket 17 includes a first or female mating portion 26 that is mated to a second or male mating portion 27 of the edge protector 18. In the illustrated embodiment, there are as many second mating portions 27 as there are brackets 17. However, it should be appreciated that the edge protector could include only one second mating portion extending between brackets. Although the first mating portion 26 of the bracket 17 includes a tapered cavity 29 and the second mating portion 27 includes a protrusion 30 with a tapered section 31 corresponding to the tapered cavity 29, it should be appreciated that the present disclosure contemplates the brackets including protrusions and the edge protector including the tapered cavity for receiving the protrusion. The tapered cavity 29 of the bracket 17 and the tapered section 31 of the protrusion 30 preferably include identical taper angles 32. The identical taper angles 32 provide an increased contact surface area at an interface 28 between the bracket 17 and the edge protector 18, thereby reducing stress at the interface 28 caused by loads acting on the assembly 16 during operation by spreading loads over a larger contact area. Because of the close fit between the bracket 17 and the edge protector 18, a side load (as illustrated by the arrow) acting on the edge protector 18 can transfer to the brackets 17 without shearing the fastener assembly 19.

The fastener assembly 19 includes a fastener 33 extending through a bore 34 defend by the first and second mating portions 26 and 27, and a barrel member 35 mated to the fastener 33. The fastener 33 preferably includes a bolt that is mated to the barrel member 35, which preferably includes a nut. An inner wall 36 of the bore 35 and an outer surface 37 of the bolt 33 define an annular clearance 38. Thus, the bolt 33 is not in contact with the edge protector 18, thereby avoiding sheer loads on the bolt 33. A load acting on a top of the edge protector 18 can be transferred to the side bar 12 through the brackets 12, and not to the bolt 33. Thus, the protector 16 and the bracket 17, and not the bolt 33, will wear. When secured, the fastener assembly 19 acts to clamp the protrusion 27 in the cavity 29.

Figure 5:
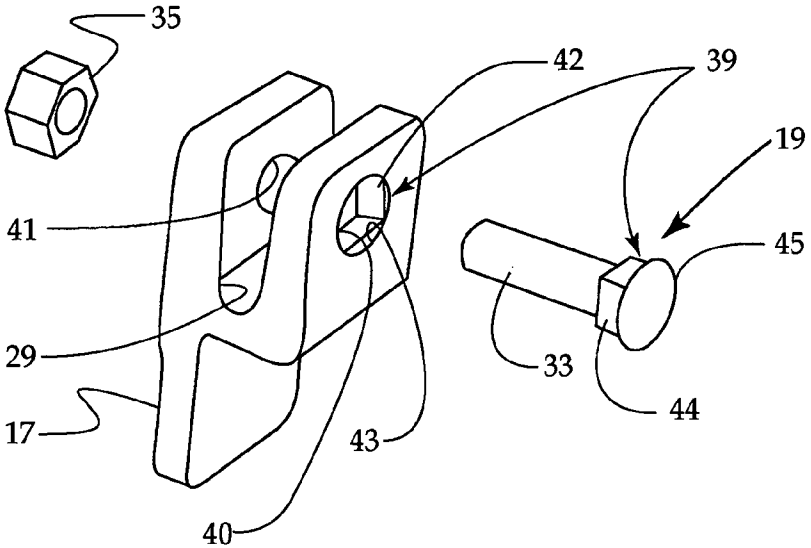
FIG. 5 is an exploded diagrammatic view of a connector and fastener assembly of the edge protector assembly of FIG. 4.

Referring to FIG. 5, there is shown an exploded view of the bracket 17 and the fastener assembly 19 of FIG. 4. Although the disclosure is described for one bracket 17 and fastener assembly 19, it should be appreciated that the following description applies to all of the brackets and fastener assemblies. Further, it should be appreciated that when the bracket 17 is mated to the edge protector 18, the protrusion 27 of the edge protector 18 is aligned in the tapered cavity 29 of the bracket 17. The fastener assembly 19 includes a rotational locking feature 39 that is operable to prohibit rotation of one of the bolt 33 and the nut 35 relative to the brackets 17. According to the first embodiment, the rotational locking feature 39 prohibits the rotation of the bolt 33 via an interaction between the bolt 33 and the bracket 17. The portion of the bore 34 defined by the bracket 17 includes a receiving bore 40 and a counter bore 41. The receiving bore 40 includes a square receiving portion 43 with a rotation stopping surface 42 and that accepts a correspondingly square shaped shoulder 44 of the bolt 33. The bolt 33 is illustrated a conventional plow bolt which includes the square shaped shoulder 44 below a head 45 of the bolt 33. A contact surface 46 of the square shoulder 44 of the plow bolt 33 mates with the rotation stopping surface 42 within the receiving bore 40. Thus, one individual can mate the nut 35 to the bolt 33 with the use of a single tightening tool to rotate nut 35 while bolt 33 remains stationary. A second tool used to prevent the bolt 33 from rotating is not necessary. The plow bolt head 45 is flush with the edge protector 18 when secured.

Figure 6:
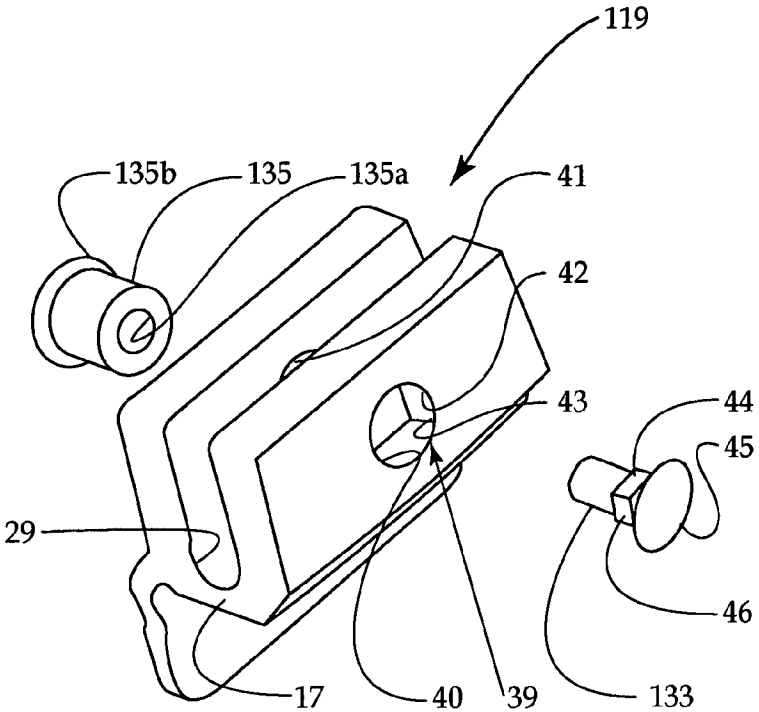
FIG. 6 is an exploded diagrammatic view of a connector and fastener assembly of an edge protector assembly, according to a second embodiment of the present disclosure.

Referring to FIG. 6, there is shown an exploded view of the bracket 17 and a fastener assembly 119. It should be appreciated that when the bracket 17 is mated to the edge protector 18, the protrusion 30 of the edge protector 18 is aligned in the tapered cavity 29 of the bracket 17. The fastener assembly 119 of the second embodiment is similar to the fastener assembly 19 of the first embodiment in that a plow bolt 133 with the square shaped shoulder 44 is received into the receiving bore 40. However, a nut of the fastener assembly 119 is not a conventional nut, but includes a threaded retainer 135 that includes a threaded bore 135*a*. The threaded retainer 135 is received into the counter bore 41 defined by the bracket 17, and a head 135*b* rests on a retainer shoulder within the bore 41. The head 135*b* of the retainer 135 is flush with the edge protector 18 and defines a drive feature (not shown) to enable the flush retainer 135 to be rotated via a suitable tool. Thus, the fastener assembly 119 is flush with both sides of the bracket 17 when secured. The retainer 135 extends partially through the portion of the bore 34 defined by the edge protector 18 (not shown). A threaded portion 149 of the plow bolt 133 is operable to mate with the threaded bore 135*a* of the retainer 135 within the portion of the bore 34 defined by the edge protector 18 (not shown) in order to secure the edge protector 18 to the bracket 17. Just as in the first embodiment, the contact surface 46 of the bolt shoulder 44 mates with the rotation stopping surface 42 within the receiving bore 40 in order to stop the rotation of the bolt 133. A tool is used to rotate retainer 135 relative to bolt 133 to secure the same.

Figure 7B:
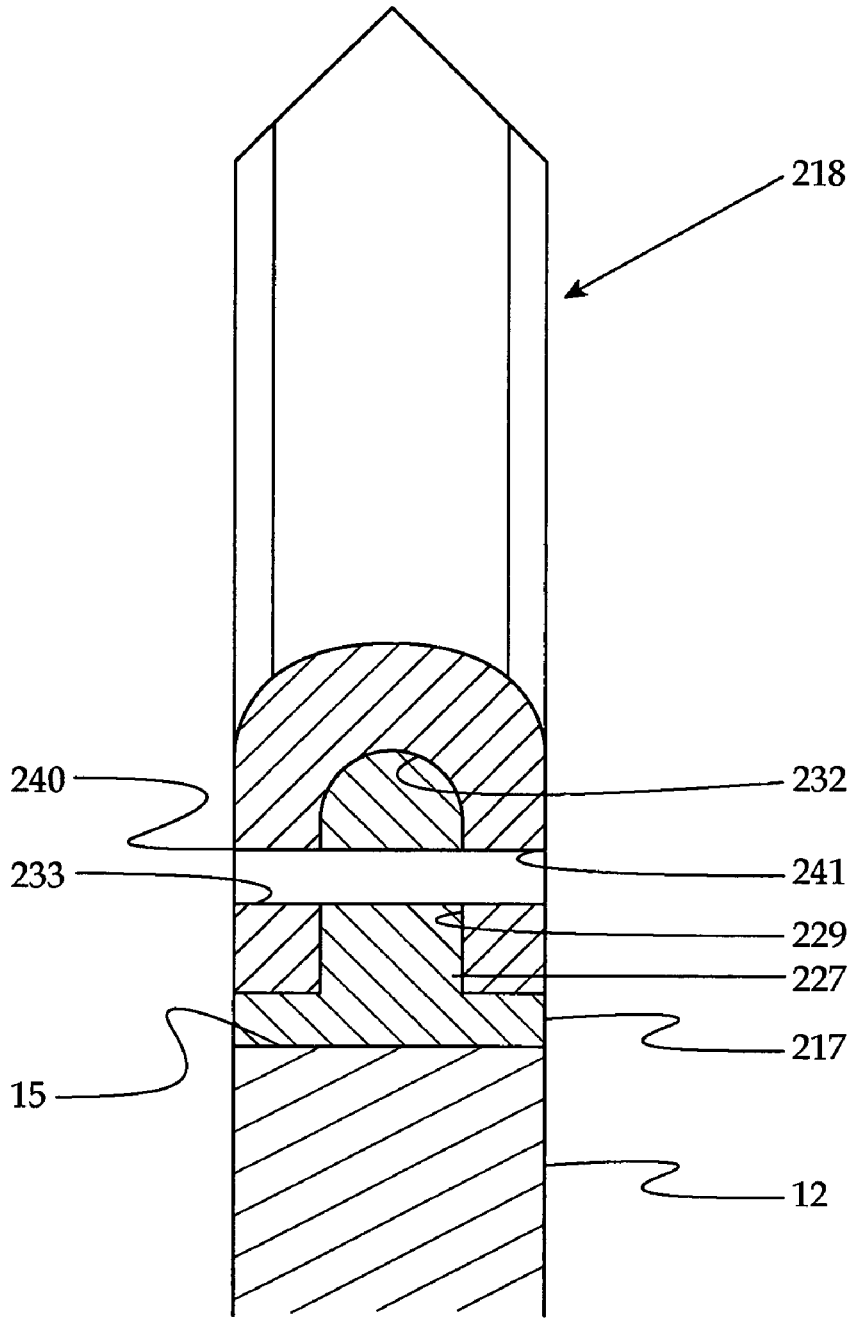
FIG. 7*b* is an isometric cross-sectional view of the edge protector of FIG. 7*a* mated to a connector.
Figure 8:
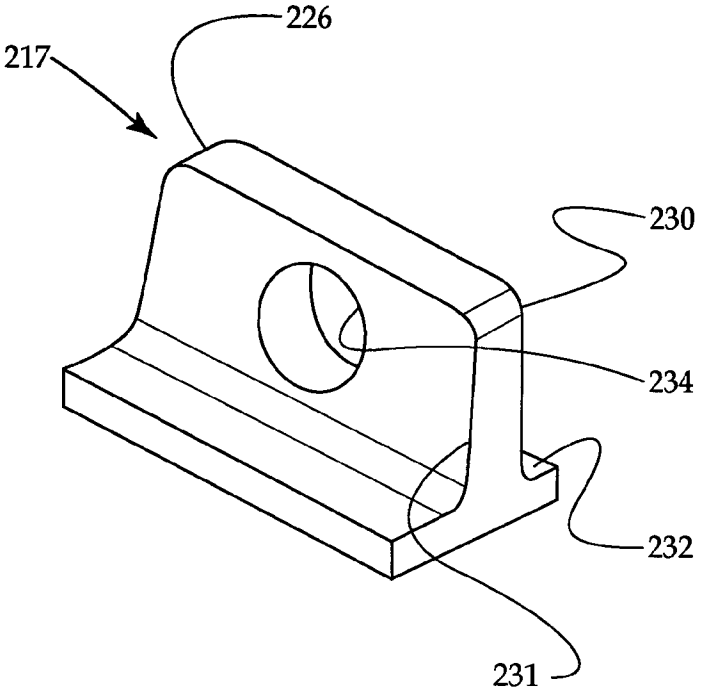
FIG. 8 is an isometric diagrammatic view of the connector of FIG. 7*b*.

Referring to FIGS. 7*a* and 7*b*, there are shown a side view of the edge protector 218, and a cross-sectional view of an edge protector 218 mated to bracket 217, respectively, according to a third embodiment of the present disclosure. Whereas the second mating portion 27 of the edge protector 18 in the first and second embodiments includes the protrusion 30 with the tapered section 31, a second mating portion 227 of the edge protector 218 in the third embodiment includes a tapered cavity 229 for each bracket 217. The portion of the bore 233 defined by the edge protector 218 includes a receiving bore 240 and a counter bore 241. The edge protector 218 is illustrated as curved and symmetrical with a first end 218*a* and a second end 218*b*. Because both ends 218*a* and 218*b* of the edge protector 218 are identical, the edge protector 218 is reversible between a first end wear position orientation and a second end wear position orientation with the bucket. In the first end wear position orientation, the first end 218*a* is positioned nearest the ground. In the second end wear position orientation, the second end 218*b* is positioned nearest the ground. During operation of the bucket assembly, it has been found that the end 218*a* or 218*b* nearest the ground is subjected to more wear than the end 218*a* or 218*b* farther from the ground. Thus, due to the symmetry of the edge protector 218, when the end 218 or 218*b* nearest the ground wears, the edge protector 218 can be rotated rather than replaced. Moreover, due to the symmetry, the edge protectors 218 can be switched between side bars 12. Not only does the symmetry extend the life of the edge protector 218, it ensures proper attachment of the edge protectors 218 to the bucket assembly 10. The curved edge protectors 218 are typically designed for use with relatively large shovels and excavators. Although not illustrated, it should be appreciated that the present disclosure contemplates the curved protectors including the tapered protrusions mating with tapered cavities of the brackets.

Referring to FIG. 8, there is shown an isometric view of the bracket 217, according to the third embodiment of the present disclosure. A first mating portion 226 of the bracket 217 includes a protrusion 230 with a tapered section 231 corresponding to the tapered cavities 229 of the edge protector 218 of FIGS. 7*a* and 7*b*. Both the tapered section 231 of the protrusion 230 and the tapered cavities 229 include identical taper angles 232, providing an increase contact surface area at an interface between the bracket 217 and the edge protector 218. Although the bracket 217 is illustrated without a flange the bracket could include a flange. Without the flange, the edge protector 218 is flush with the bucket 11.

Referring to FIG. 9, there is shown an isometric view of a fastener assembly 219 extending through the bracket 217, according to the third embodiment of the present disclosure. It should be appreciated that when the edge protector 218 is mated to the bracket 217, the protrusion 230 is surrounded by the edge protector 218. The fastener assembly 219 includes a retainer system thoroughly described in U.S. Pat. No. 6,712,551 B2, issued to Livesay et al., on Mar. 30, 2004. The nut of the fastener assembly 219 is not a convention nut, but rather a threaded retainer 235 that defines a threaded bore 235*a*. The retainer 235 is positioned within the portion of the bore 234 defined by the bracket 217, and partially into the receiving bore 241 of the edge protector 218. Thus, the retainer 235 is hidden in the assembled edge protector assembly 216. The retainer 235 includes a contact surface 246 operable to mate with a rotation stopping surface of an inner surface of the edge protector (not shown). A head 245 of the bolt 233 includes a drive feature 245*a* that mates with a suitable tool that is operable to rotate the bolt 233. Thus, a conventional bolt 233 can be threaded into the threaded bore 235*a* of the retainer 235 with a suitable tool as the retainer 235 is held stationary by the interaction between the contact surface 246 of the retainer 235 and the rotation stopping surface of the edge protector 218. The fastener assembly 219 is flush with the edge protector 218 on both the sides of the edge protector 218.

Industrial Applicability

Referring to FIGS. 1–9, the operation of the present disclosure will be discussed for bucket assembly 10. It should be appreciated that the present disclosure contemplates the bucket assembly being attached to various types of work machines, including, but not limited to, wheel loaders, mining shovels, excavators, and bulldozer blades with side edges. The present disclosure is also applicable to smaller buckets, including but not limited to skid steer loader buckets. Although a method of protecting the edges 15 of bucket assembly 10 will be discussed for only one edge 15, it should be appreciated that the method is the same for protecting both edges 15.

In order to protect the edge 15 of the bucket assembly 10, the edge protector assembly 16, 116, 216 is attached to the edge 15. The edge protector 18, 218 can be attached to the brackets 17, 217 by the work machine operator in the field, if necessary. The brackets 17, 217 are welded onto the side bar 12, and the edge protector 18, 218 is mated to the brackets 17, 217. In order to secure the edge protector 18, 218 to the brackets 17, 217, the fastener assembly 19, 119, 219 extends through the bore 34, 234. In the first and second embodiments in which the brackets 17 define the receiving bore 40 and the counter bore 41, the plow bolt 33, 113 is inserted in the receiving bore 40, and the nut, being either the conventional nut 35 in the first embodiment or the threaded retainer 135 in the second embodiment, is threaded onto the threaded portion 49, 149 of the plow bolt 33, 133. Referring specifically to FIG. 5, the plow bolt 33 in the first embodiment extends through both the receiving bore 40 and the counter bore 41, and the nut 35 is threaded to the plow bolt 33 in the outer area 24 of the edge protector assembly 16. The rotational locking feature 39 prevents the rotation of the bolt 33 via the interaction between the contact surface 46 on the square shaped shoulder 44 of the bolt 33 and the rotation stopping surface 42 of the receiving bore 40. Thus, the nut 35 can be secured to the stationary bolt 33 using a suitable tool, such as a wrench, to rotate the nut 35. When the nut 35 is securely fastened to the bolt 33, the fastener assembly 19 is flush with the inner surface of the edge protector 18, but not the outer surface of the edge protector 18.

Referring specifically to FIG. 6, in the second embodiment, the plow bolt 133 extends through the receiving bore 40 and the portion of the bore 34 defined by the protrusion 30 of the edge protector 18. Within the bore 34, the threaded bore 135*a* of the retainer 135 is linked with the threaded portion 149 of the bolt 133 by rotating the retainer 135 with a suitable tool, such as an allen wrench, mated to the drive feature. Similar to the first embodiment, only one tool is needed to link the threaded retainer 135 with the bolt 133 because the contact surface 46 of the square shaped shoulder 44 of the bolt 133 mates with the rotation stopping surface 42 within the receiving bore 40. Thus, the rotational locking feature 39 prohibits the rotation of the bolt 33 via the interaction between the bolt 133 and the bracket 17 when the retainer 135 is being tightened. Both sides of the fastener assembly 119 are flush with the edge protector 18.

Referring specifically to FIG. 9, according to the third embodiment, the operator can secure the edge protector 218 to the brackets 217 similarly to the first and second embodiments except that the receiving bore 240 and the counter bore 241 are defined by the edge protector 218 rather than the brackets 217. The threaded retainer 235 is positioned within the portion of the bore 234 that is defined by the bracket 217, and the bolt 233 is threaded into the threaded bore 235*a* of the retainer 235. The threaded retainer 235 is prevented from rotating by the interaction between the contact surface 246 defined by the edge protector 218 and the rotation stopping surface 242 of the threaded retainer 235. Thus, the fastener assembly 219 can be linked by rotating the bolt 233 with one suitable tool while the rotational locking feature 239 prevents the threaded retainer 235 from rotating. The fastener assembly 219 is flush with both sides of the edge protector 218.

In all embodiments, the edge 15 of the bucket assembly 10 is also preferably protected by avoiding shear loads on the fastener assembly 19, 119, 219, at least in part, by positioning the bolt 33, 133, 233 out of contact with either the edge protector 19, 219 or the brackets 17, 217. Referring specifically to FIG. 4, the annular clearance 38 defined the inner surface of the bore 34 and the outer surface of the bolt 33 allows the loads acting on the edge protector assembly 16 to be transferred to the brackets 17 rather than the fastener assembly 19. Loads acting on top of the edge protector assembly 16 will be transferred to the bucket side bar 12, and will avoid the fastener assembly 19 due to the annular clearance 38. Thus, the loads acting on the edge protector assembly 19 can be transferred to bucket assembly 10 through the edge protector 18 and not the fastener assembly 19. Although the method of avoiding shear loads on the fastener assembly 19 is described and illustrated for the first embodiment, it should be appreciated that the method operates similarly in all embodiments.

However, according to the third embodiment (as shown in FIGS. 7–9), the edge protector 218 defines the receiving and counter bores 240 and 241, respectively, and thus, an annular clearance 238 is defined by the fastener assembly 219 and the brackets 217. The fastener assembly 219 is preferably separated from the brackets 217 via the annular clearance 238. In all embodiments, because shear loads on the fastener assembly 19, 119, 219 are avoided, the likelihood of premature failure of the fastener assembly 19, 119, 219 is reduced.

In all embodiments, the edge 15 of the bucket assembly 10 is preferably protected by reducing stress at the interface 28 between the brackets 17, 217 and the edge protector 18, 218. The stress is reduced by contacting at the interface 28 identical taper angles 32, 232 of the corresponding mating portions 26, 226 and 27, 227 of the brackets 17, 217 and edge protector 18, 218, respectively. Regardless of whether the mating portion 27, 227 includes the protrusion 30 or the tapered cavity 229, the edge protector 18, 218 can be mated with the brackets 17, 217. The identical taper angles 32, 232 increase the contact surface area at the interface 28, thereby allowing the loads to transfer from the edge protector 18, 218 to the brackets 17, 217 welded to the bucket assembly 10. Thus, a load acting along the length of the edge protector assembly 16, 216 can also be transferred to the brackets 17, 217 and avoid the fastener assembly 19, 119, 219 due to the close fit between the bracket 17, 217 and the edge protector 18, 218. Moreover, in the embodiments including the straight edge protectors 18, the tooth 52 that mates with the protrusion 54 of the corner protector 49 allows a load acting along the length of the assembly 16 to also be transferred to the corner protector 49.

Referring specifically to FIG. 3, the edge protector assembly 16, 116, 216 protects the edge 15 of the bucket assembly 10 while also reducing carry back by limiting the inner overhang area 22 of the edge protector assembly 16, 116, 216. Although preferably the edge protector assembly 16, 116, 216 does not include the inner overhang area 22, and thus, is flush with the side wall surface 14 of the bucket assembly 10, the present disclosure contemplates and is illustrated in FIG. 2 as including the inner overhang area 22 that is up to one half of the protected area 25 of the edge 15. Regardless of whether the inner overhang area is zero or half of the protected area 25 of the edge 15, the inner overhang area 22 is sufficiently small that its extension into the bucket 11 does not trap a significant amount of material in the bucket 11. Rather, the material can slide down the side surface wall 14 and the edge protector assembly 16, 116, 216, and out the bucket assembly 10. Because all the material being transported can be ejected from the bucket 1, the productivity of the work machine having bucket assembly 10 is increased.

The present disclosure is advantageous because the edge protector assembly 16, 116, 216 not only protects the edge 15 of the bucket assembly 10, but also can be replaced by one man with relative ease, absorbs the loads that may act on the assembly 16, 116, 216 during operation, and limits carry back. Because the edge protector assembly 16, 116, 216 is attached to the edge 15 at a position where the bucket assembly 10 engages material, the edge protector 18, 218 protects the edge 15 from rocks and debris that could damage the side bars 12. Thus, over time, the edge protector assembly 16, 116, 216, rather than the side bars 12, will wear. It is more economical and less time consuming to replace the edge protector assemblies 16, 116, 216 than the side bars 12. In fact, the curved edge protectors 218 can be rotated such that the end 218*a* or 218*b* that was receiving less wear can be placed in the position in which it will receive the most wear.

The present disclosure further allows the work machine operator in the field to rotate the position, or replace, the edge protectors 18, 218. Because each embodiment includes the rotational locking feature 39, 239 that prevents the rotation of either the nut 235 or the bolt 33, 133, a second tool to hold the nut 235 or bolt 33, 133 stationary when linking the fastener assembly 19, 119, 219 is unnecessary. Thus, only one suitable tool used by one individual is needed. The fact that the edge protector assembly 16, 116, 216 can be replaced or rotated with relative ease by one person further reduces the amount of maintenance time and costs associated with the edge protector assemblies 16, 116, 216.

Moreover, the edge protector assembly 16, 116, 216 does not adversely affect the productivity of the bucket assembly 10. Because the edge protector assembly 16, 116, 216 is preferably flush with the side wall surface 14 and, at most, slightly extended into the bucket 11, material that is being shoveled can be ejected from the bucket 11 without a portion being trapped between the inner overhang 22 and the side wall surface 14. Thus, the present disclosure limits carry back of material and allows use of the maximum capacity of the bucket 11, thereby increasing the productivity of the work machine having bucket assembly 10.

The present disclosure also increases the life of the edge protector assembly 16 by avoiding shear loads on the fastener assembly 19, 119, 219 and reducing stress at the interface 28 between the brackets 17, 217 and the edge protector 18, 218. The fastener assembly 19, 119, 219 is not designed to withstand the loads that the edge protector 18, 218, the brackets 17, 217, and the bucket assembly 10 can withstand. If the fastener assembly 19, 119, 219 fails, the edge protector assembly 16, 116, 216 will fail to protect the edge 15. Thus, the present disclosure reduces the risk of premature failure of the fastener assembly 19, 119, 219 by separating the fastener assembly 19, 119, 219 from either the bracket 17, 217 or the edge protector 18, 218 by the annular clearance 38, 238, thereby reducing the loads transferred to the fastener assembly 19, 119, 219. Moreover, the present disclosure reduces the stress concentrated at the interface 28 between the bracket 17, 217 and the edge protector 18, 218 by increasing the contact between the tapered cavity 29, 229 and the tapered section 31, 231 of the protrusion 30, 230. Regardless of whether the bracket 17, 217 or the edge protector 18, 218 includes the tapered cavity 29, 229, the side loads acting on the edge protector 18, 218 can be transferred to the brackets 17, 217 rather than the bolt 33, 133, 233. Thus, the present disclosure extends the life of the edge protector assembly 16, 116, 216, thereby reducing costs.

It should be understood that the above description is intended for illustrative purposes only, and is not intended to limit the scope of the present disclosure in any way. Thus, those skilled in the art will appreciate that other aspects, objects, and advantages of the disclosure can be obtained from a study of the drawings, the disclosure and the appended claims.

What is claimed is:

1. A bucket assembly comprising:

a bucket including at least one wall surface with an edge;

at least one connector being attached to the edge, and each connector including a first mating portion;

an edge protector assembly including an edge protector including at least one second mating portion mated to the first mating portion of the connectors and a fastener assembly being operable to secure the edge protector to the connector;

the edge protector assembly covering a protection area of the edge, and the edge protector assembly including an inner overhang area that is between zero and one half of the protection area; and the edge protector includes a first end and a second end and being reversible between a first end wear position orientation and a second end wear position orientation with the bucket.

2. The bucket assembly of claim 1 wherein the fastener assembly includes a fastener extending through a bore defined by the first and second mating portions; and an inner wall of the bore and an outer surface of the fastener being out of contact with one another.

3. The bucket assembly of claim 1 wherein one of the first and second mating portions being a protrusion with a tapered section and the other of the first and second mating portions including a tapered cavity corresponding to the tapered section.

4. The bucket assembly of claim 3 wherein the tapered cavity and the tapered section of the protrusion include identical taper angles.

5. The bucket assembly of claim 1 wherein the fastener assembly includes a fastener extending through a bore defined by the first and second mating portions, a barrel member mated to the fastener, and a rotational locking feature being operable to prohibit rotation of one of the barrel member and fastener relative to the connector.

6. The bucket assembly of claim 5 wherein the fastener includes a bolt, and the barrel member includes a nut; and one of the bolt and the nut includes a surface mated to a rotation stopping surface of one of the connector and edge protector.

7. The bucket assembly of claim 1 wherein the first mating portion is one of a male mating portion and a female mating portion; and the second mating portion is an other of the male mating portion and the female mating portion.

8. The bucket assembly of claim 1 wherein the connector includes a single flange attached to the wall surface of the bucket.

9. A bucket assembly comprising:

a bucket including at least one wall surface with an edge;

an edge protector assembly attached to the edge, and including at least one connector, an edge protector and a fastener assembly, and each connector includes a first mating portion mated to at least one second mating portion of the edge protector, and the fastener assembly being operable to clamp the edge protector to each connector, and including a fastener extending through a bore defined by the first and second mating portions, and an inner wall of the bore and an outer surface of the fastener being out of contact with one another; and one of the first and second mating portions being a protrusion with a tapered section and the other of the first and second mating portions including a tapered cavity corresponding to the tapered section.

10. The bucket assembly of claim 9 wherein the edge protector assembly covers a protection area of the edge, and the edge protector assembly includes an inner overhang area that is between zero and one half of the protection area.

11. The bucket assembly of claim 9 wherein the cavity and the tapered section of the protrusion include identical taper angles.

12. The bucket assembly of claim 9 wherein the fastener assembly includes a barrel member mated to the fastener, and a rotational locking feature being operable to prohibit rotation of one of the barrel member and fastener relative to the connectors; and the fastener assembly being out of contact with the bucket.

13. The bucket assembly of claim 12 wherein the fastener includes a bolt and the barrel member includes a nut; and one of the bolt and the nut includes a surface mated to a rotation stopping surface of one of the edge protector and connector.

14. A bucket assembly comprising:

a bucket including a first wall surface with a first edge, and a second wall surface with a second edge;

a first connector being attached to the first edge;

a second connector being attached to the second edge;

a first edge protector attached to one of the first and second connectors;

a second edge protector attached to an other of the first and second connectors;

the first and second edge protectors being reversible with each other between a first wear orientation on the first edge and a second wear orientation on the second edge; and the connectors are welded to the bucket.

15. The bucket assembly of claim 14 wherein the first edge protector includes a first end and a second end and being reversible between a first end wear position orientation and a second end wear position orientation with respect on the first edge; and the second edge protector includes a first end and a second end and being reversible between a first end wear position orientation and a second end wear position orientation on the second edge.

16. The bucket assembly of claim 14 wherein each of the connectors is attached to one of the edge protectors with a fastener assembly.

17. The bucket assembly of claim 16 wherein the fastener assembly includes a bolt mated to a nut.

18. The bucket assembly of calim 14 wherein the first mating portion is one of a male mating portion and a female mating portion; and the second mating portion is an other of the male mating portion and the female mating portion.

19. The bucket assembly of claim 14 wherein the connector includes a single flange attached to the wall surface of the bucket.

20. A bucket assembly comprising:

a bucket including at least one wall surface with an edge;

at least one connector, each including a first mating portion;

an edge protector attached to the edge, and including at least one second mating portion being operable to mate to the first mating portion of each connector;

a fastener assembly being operable to secure the edge protector to each connector;

one of the first and second mating portions being a protrusion with a tapered section and the other of the first and second mating portions including a tapered cavity that receives the tapered section;

the fastener assembly includes a fastener extending through a bore defined by the first and second mating portions; and an inner wall of the bore and an outer surface of the fastener being out of contact with one another.

21. The bucket assembly of claim 10 wherein the cavity and the tapered section of the protrusion include identical taper angles.

22. A bucket assembly comprising:

a bucket including at least one wall surface with an edge;

at least two connectors, each including a first mating portion;

an edge protector attached to the edge, and including at least one second mating portion being operable to mate to the first mating portion of each connector;

a fastener assembly being operable to secure the edge protector to each connector;

one of the first and second mating portions being a protrusion with a tapered section and the other of the first and second mating portions including a tapered cavity that receives the tapered section; and the fastener assembly includes a fastener extending through a bore defined by the first and second mating portions, a barrel member mated to the fastener, and a rotational locking mechanism being operable to prohibit rotation of a portion of one of the barrel member and fastener to the connectors.

23. The bucket assembly of claim 22 wherein the fastener includes a bolt and the barrel member includes a nut; and at least one of the bolt and the nut includes a surface operable to mate to a rotation stopping surface of at least one of the edge protector and the connectors.

24. A bucket assembly comprising a bucket including at least one wall surface with an edge;

at least one connector being attached to the edge, and each connector including a first mating portion;

an edge protector assembly including an edge protector including at least one second mating portion mated to the first mating portion of the connectors and a fastener assembly being operable to secure the edge protector to the connectors;

the edge protector assembly covering a protection area of the edge, and the edge protector assembly including an inner overhang area that is between zero and one half of the protection area;

the fastener assembly includes a fastener extending through a bore defined by the first an second mating portions, a barrel member mated to the fastener, and a rotational locking feature being operable to prohibit rotation of one of the barrel member and fastener relative to the connectors;

the fastener includes a bolt, and the barrel member includes a nut;

one of the bolt and the nut includes a surface mated to a rotation stopping surface of one of the connector and edge protector;

an inner wall of the bore and an outer surface of the fastener define an annular clearance;

one of the first and second mating portions being a protrusion with a tapered section and the other of the first and second mating portions include a tapered cavity corresponding to the tapered section; and the edge protector includes a first and a second end and being reversible between a first end wear position orientation and a second end wear position orientation with the bucket.

25. A bucket assembly comprising:

a bucket including at least one wall surface with an edge; and an edge protector assembly attached to the edge, and including at least one connector, an edge protector and a fastener assembly, and each connector includes a first mating portion mated to at least one second mating portion of the edge protector, and the fastener assembly being operable to secure the edge protector to each connector, and including a fastener extending through a bore defined by the first and second mating portions, and an inner wall of the bore and an outer surface of the fastener being out of contact with one another;

the edge protector assembly covers a protection area of the edge and includes an inner overhang area that is between zero and one half of the protection area; and one of the first and second mating portions being a protrusion with a tapered section and the other of the first and second mating portions including a cavity corresponding to the tapered section, and the tapered cavity and the tapered section of the protrusion include identical taper angles.

* * * * *